US011096486B1

(12) United States Patent
Ke

(10) Patent No.: US 11,096,486 B1
(45) Date of Patent: Aug. 24, 2021

(54) SHELF STRUCTURE

(71) Applicant: Chia-Nan Ke, Changhua (TW)

(72) Inventor: Chia-Nan Ke, Changhua (TW)

( * ) Notice: Subject to any disclaimer, the term of this patent is extended or adjusted under 35 U.S.C. 154(b) by 0 days.

(21) Appl. No.: 16/992,069

(22) Filed: Aug. 12, 2020

(51) Int. Cl.

| | |
|---|---|
| ***A47B 47/00*** | (2006.01) |
| ***A47B 57/00*** | (2006.01) |
| ***A47B 57/54*** | (2006.01) |
| ***A47B 96/02*** | (2006.01) |
| ***A47B 57/34*** | (2006.01) |

(52) U.S. Cl.
CPC ..... *A47B 57/545* (2013.01); *A47B 47/0083* (2013.01); *A47B 57/34* (2013.01); *A47B 96/021* (2013.01)

(58) Field of Classification Search
CPC ... A47B 57/34; A47B 57/545; A47B 47/0083; A47B 96/021
See application file for complete search history.

(56) References Cited

U.S. PATENT DOCUMENTS 3,065,860 A * 11/1962 Swanson ..... A47B 96/021 211/153
8,016,140 B2 * 9/2011 Hsieh ..... A47B 57/482 211/187
9,854,906 B1 * 1/2018 Ke ..... A47B 47/0091
2009/0250572 A1 * 10/2009 Cheng ..... A47F 5/13 248/188.6
2010/0155352 A1 * 6/2010 Hsieh ..... A47B 47/0083 211/134
2016/0120313 A1 * 5/2016 Tang ..... A47B 47/0091 211/134
2018/0372136 A1 * 12/2018 Cheng ..... A47B 57/545

FOREIGN PATENT DOCUMENTS

JP 3209078 U * 3/2017 ..... A47B 96/021

* cited by examiner

*Primary Examiner* — Kimberley S Wright

(57) ABSTRACT

A shelf structure has at least four columns and at least one supporting board provided with a plurality of circular gaskets respectively jacketing onto the columns. Each column has a plurality of positioning grooves, each circular gasket having a tapered shape and a fastening rib on an inner surface. The supporting board comprises a frame and a board member. The frame is provided with a raised internal surface, four top edges and four bottom edges of the frame are respectively provided with a horizontal rib. Each horizontal rib respectively forms a concave arced groove at each corner of the frame, and each concave arced groove is provided with an assembling arc member with two wing portions at each side configured to engage with the frame, the assembling arc member and the concave arc groove form a tapered hollow casing for engaging with the respective circular gasket.

5 Claims, 10 Drawing Sheets

SHELF STRUCTURE

BACKGROUND OF INVENTION

Field of Invention

The present invention relates to a shelf structure, and more particularly to a shelf structure with various assembly.

Description of Related Art

The improved structure of the conventional shelf, as shown in FIG. 9 and FIG. 10, includes: at least four columns 40 and at least one supporting board 60 with a plurality of circular gaskets 50 jacketed onto the four columns 40. The column 40 has a plurality of positioning grooves 41. The circular gasket 50 is a tapered circular gasket 50 with a narrow top and a wide bottom and has a horizontal fastening rib 51 inside. The supporting board 60 consists of a frame 61 and a board member 62. The inner surface of the frame 61 is provided with the raised surface 611, the upper and lower edges of the four sides of the frame 61 are all bent as parallel horizontal ribs 612, and a protecting lip 613 is disposed at the ends of the two horizontal ribs 612. The two sides of the horizontal ribs 612 are apart and bent at each corner of the frame 61 to form a concave arc groove 614. Each of the concave arc grooves 614 is configured with an assembling arc member 615, both sides of the assembling arc member 615 are extended with a wing portion 6151, and an upper end of the assembling arc member 615 has a horizontal abutting rib 6152. The abutting rib 6152 is higher than the wing portions 6151 on both sides and then fixed to the frame 61 by the wing portion 6151, so a hollow cone shape casing 63 is formed by the assembling arc member 615 and the concave arc groove 614. The board member 62 is housed in the frame 61 and fixed to the horizontal rib 612 at the upper edge of the frame 61. The part of the frame 61 without the board member 62 is used as a guardrail 616. The casing 63 makes the circular gasket 50 and the casing 63 of the supporting board 60 to have tight face to face contact, to increase strength between the circular gasket 50 and the column 40.

However, the structure of the shelf as described above still has the following shortcomings in actual use: the casing 63 formed by the concave arc groove 614 and the assembling arc member 615 has a cone shape, the inner wall of the casing 63 is sleeved onto the tapered circular gasket 50, so that the circular gasket 50 is tightly pressed against the column 40. Therefore, the assembly is restricted.

Therefore, it is desirable to provide a shelf structure to mitigate and/or obviate the aforementioned problems.

SUMMARY OF INVENTION

An objective of present invention is to provide a shelf structure, which is capable of improving the above-mention problems.

In order to achieve the above mentioned objective, a shelf structure has at least four columns and at least one supporting board provided with a plurality of circular gaskets respectively jacketing onto the columns. Each column has a plurality of positioning grooves, each circular gasket having a tapered shape and a fastening rib on an inner surface. The supporting board comprises a frame and a board member. The frame is provided with a raised internal surface, four top edges and four bottom edges of the frame are respectively provided with a horizontal rib. Each horizontal rib respectively forms a concave arced groove at each corner of the frame, and each concave arced groove is provided with an assembling arc member with two wing portions at each side configured to engage with the frame, the assembling arc member and the concave arc groove form a tapered hollow casing for engaging with the respective circular gasket.

Other objects, advantages, and novel features of invention will become more apparent from the following detailed description when taken in conjunction with the accompanying drawings.

DETAILED DESCRIPTION OF PREFERRED EMBODIMENT

Figure 1:
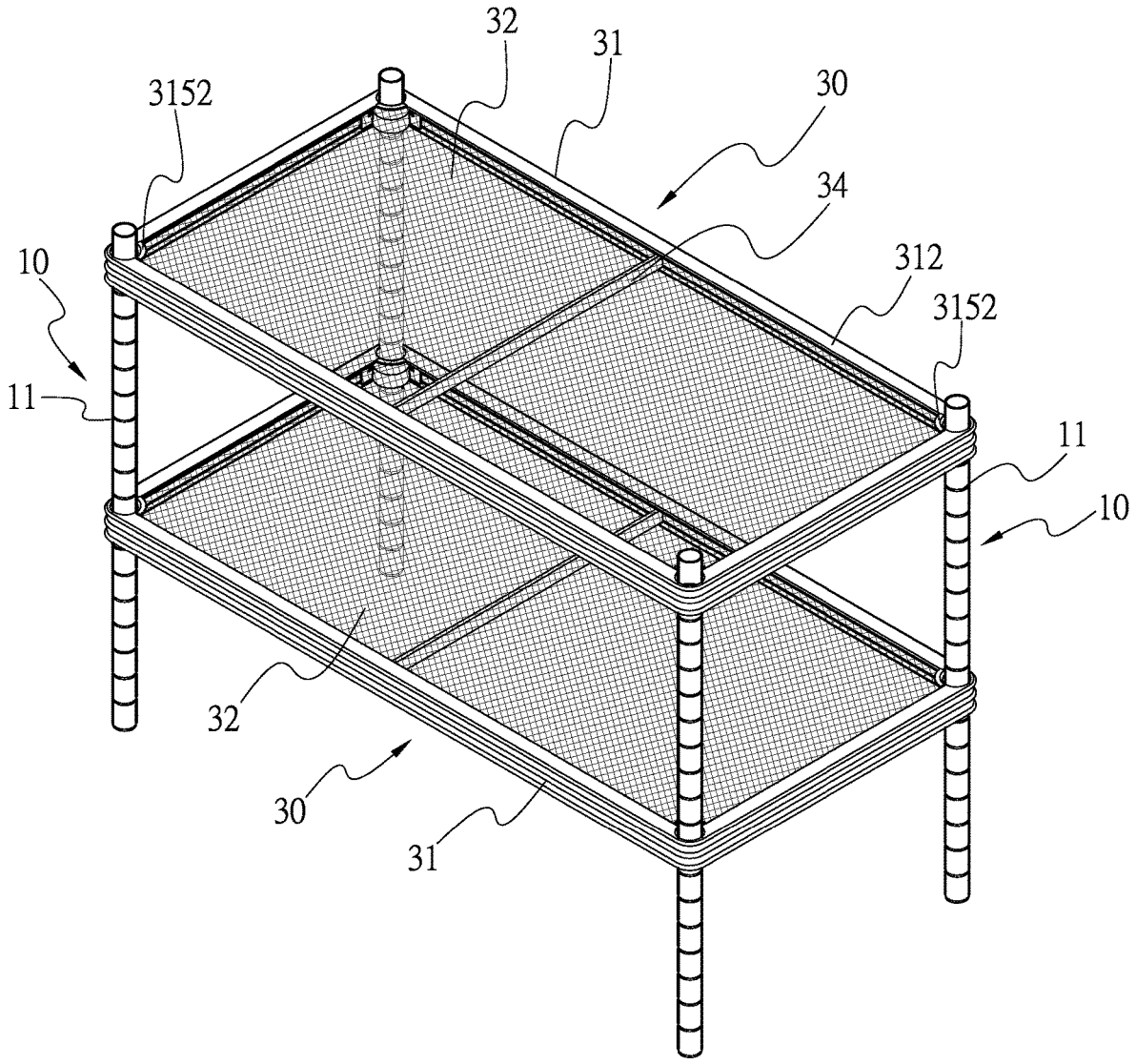
FIG. 1 is a three-dimensional combination drawing according to a preferred embodiment of the present invention.

Please refer to FIGS. 1-5. A shelf structure comprising: at least four columns 10 and at least one supporting board 30 provided with a plurality of circular gaskets 20 respectively jacketing onto the columns 10. Each column 10 has a plurality of positioning grooves 11. Each circular gasket 20 has a tapered shape and a fastening rib 21 on an inner surface. The supporting board comprises a frame 31 and a board member 32, the frame 31 is provided with a raised internal surface 311, four top edges and four bottom edges of the frame 31 are respectively provided with a horizontal rib 312, and each horizontal rib 312 on the top edges further has a protecting lip 313. Two parallel sides of each horizontal rib 312 respectively forms a concave arced groove 314 at each corner of the frame 31, and each concave arced groove 314 is provided with an assembling arc member 315 with two wing portions 3151 at each side configured to engage with the frame 31 and a horizontal bent abutting rib 3152 at its top end. Furthermore, the abutting rib 3152 is higher than the two wing portions 3151 on the sides of the assembling arc member 315. The wing portions 3151 secure the assembling arc member 315 with the frame 31, and two ends of the abutting rib 3152 make contact with the horizontal ribs 312 on both sides of the concave arc groove 314. The assembling arc member 315 and the concave arc groove 314 form a tapered hollow casing 33 for engaging with the respective circular gasket 20. The board member 32 is accepted in the frame 31 and secured with the horizontal ribs 312 of the frame 31, and a portion of the frame 31 without the board member 32 defines as a guardrail 316.

Figure 2:
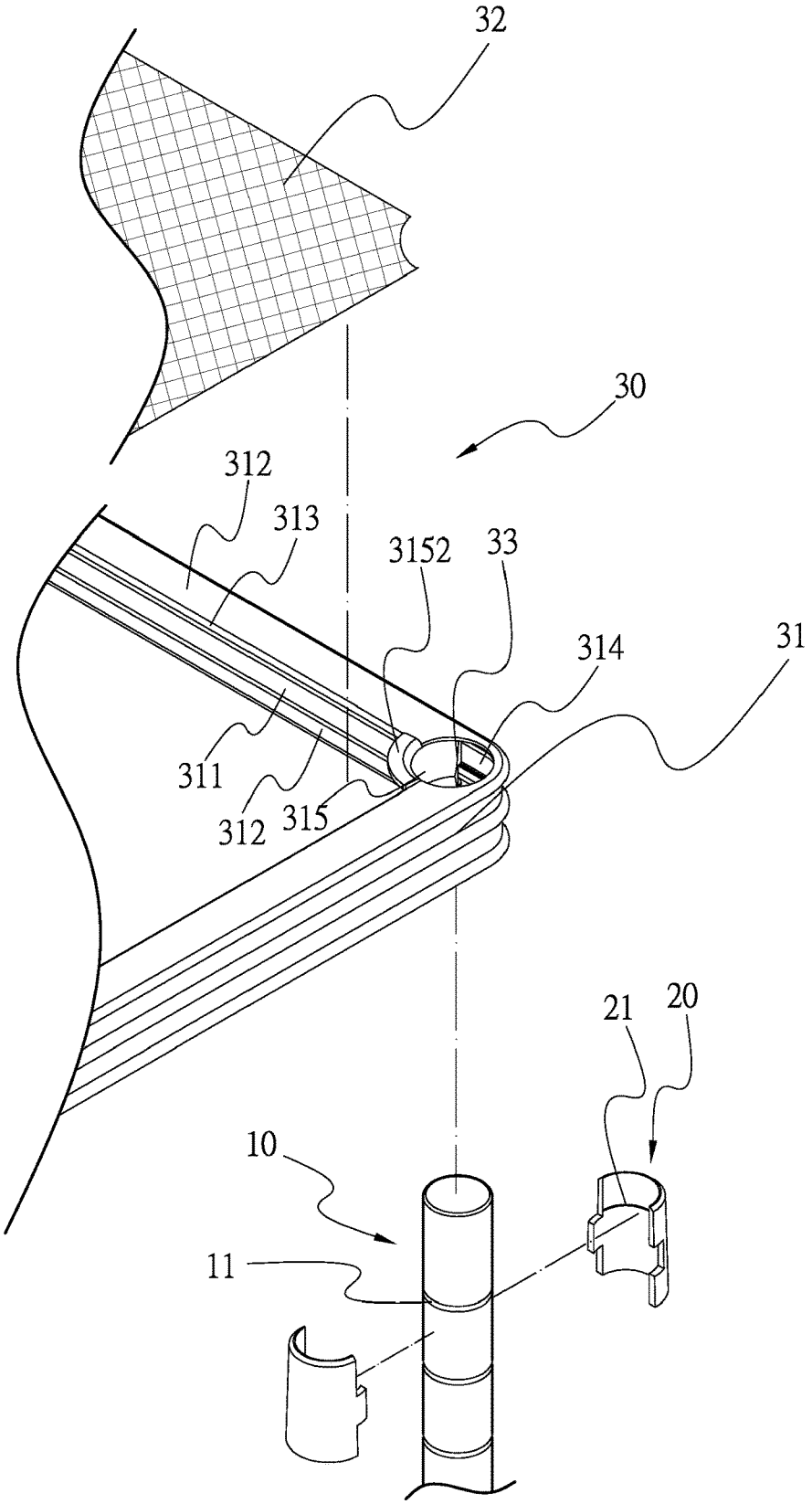
FIG. 2 is a three-dimensional exploded view according to the preferred embodiment of the present invention.
Figure 3:
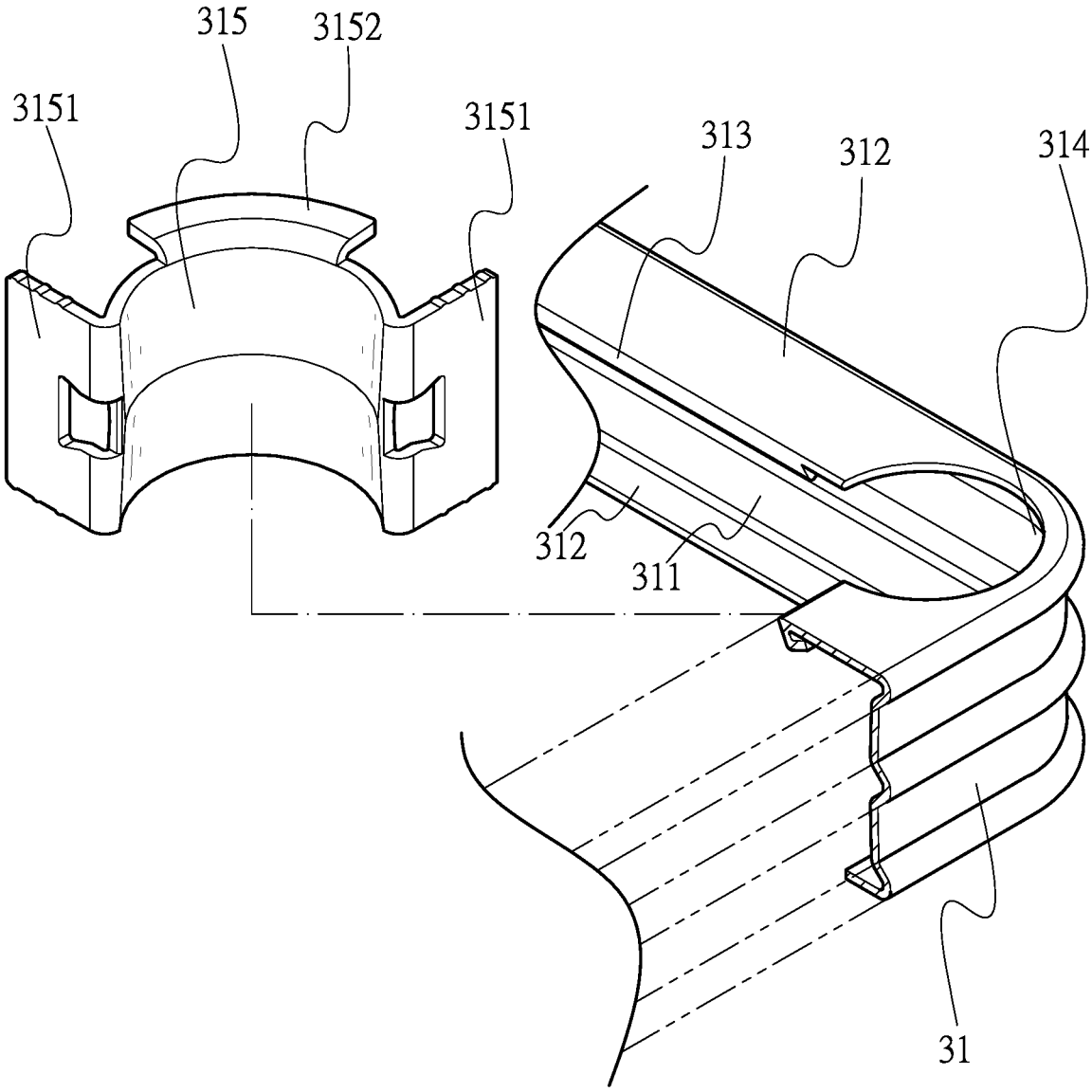
FIG. 3 is a detailed local drawing of the concave arc groove of the frame according to the preferred embodiment of the present invention.
Figure 4:
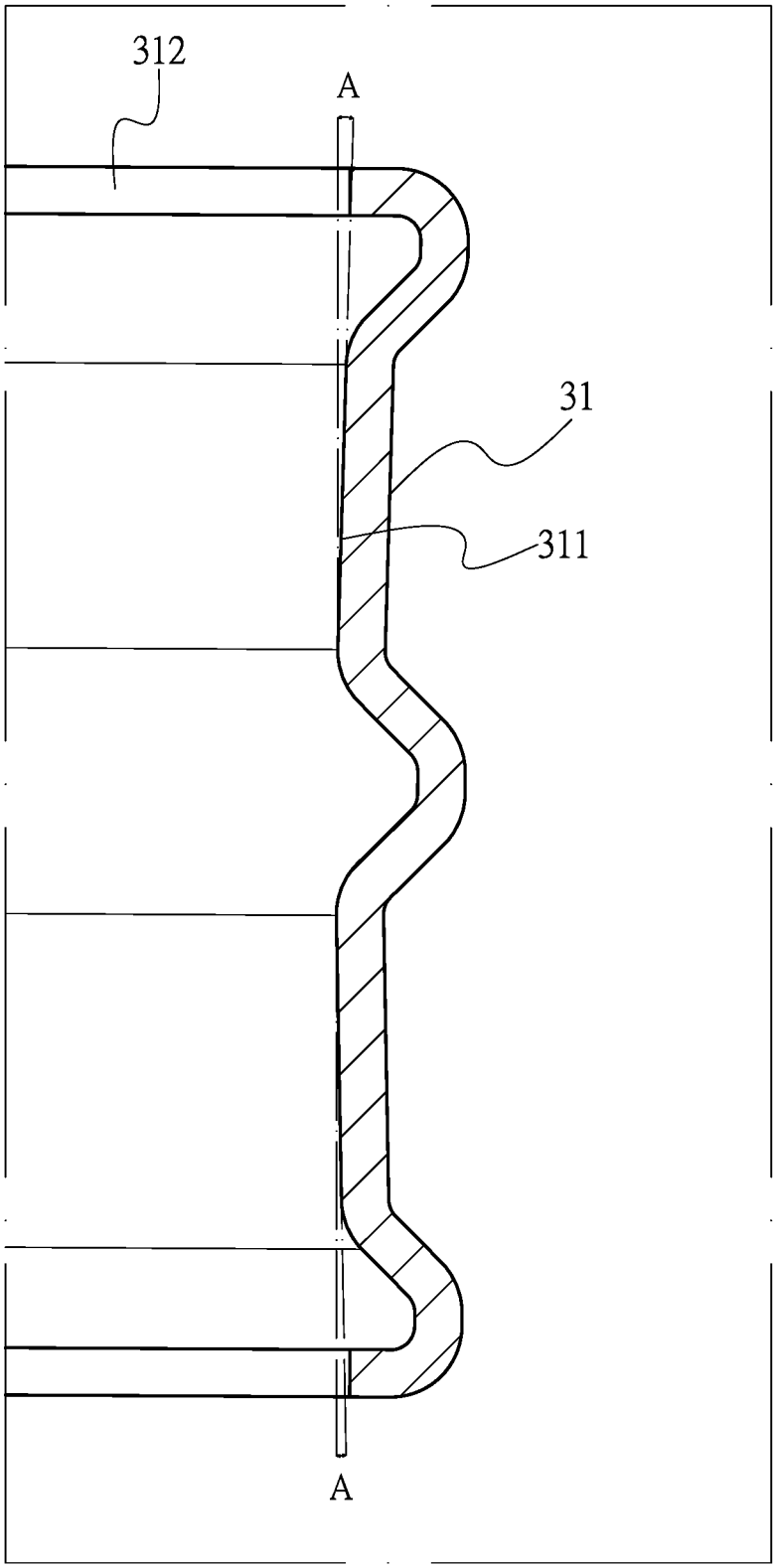
FIG. 4 is a partial enlarged view of the frame according to the preferred embodiment of the present invention.
Figure 5:
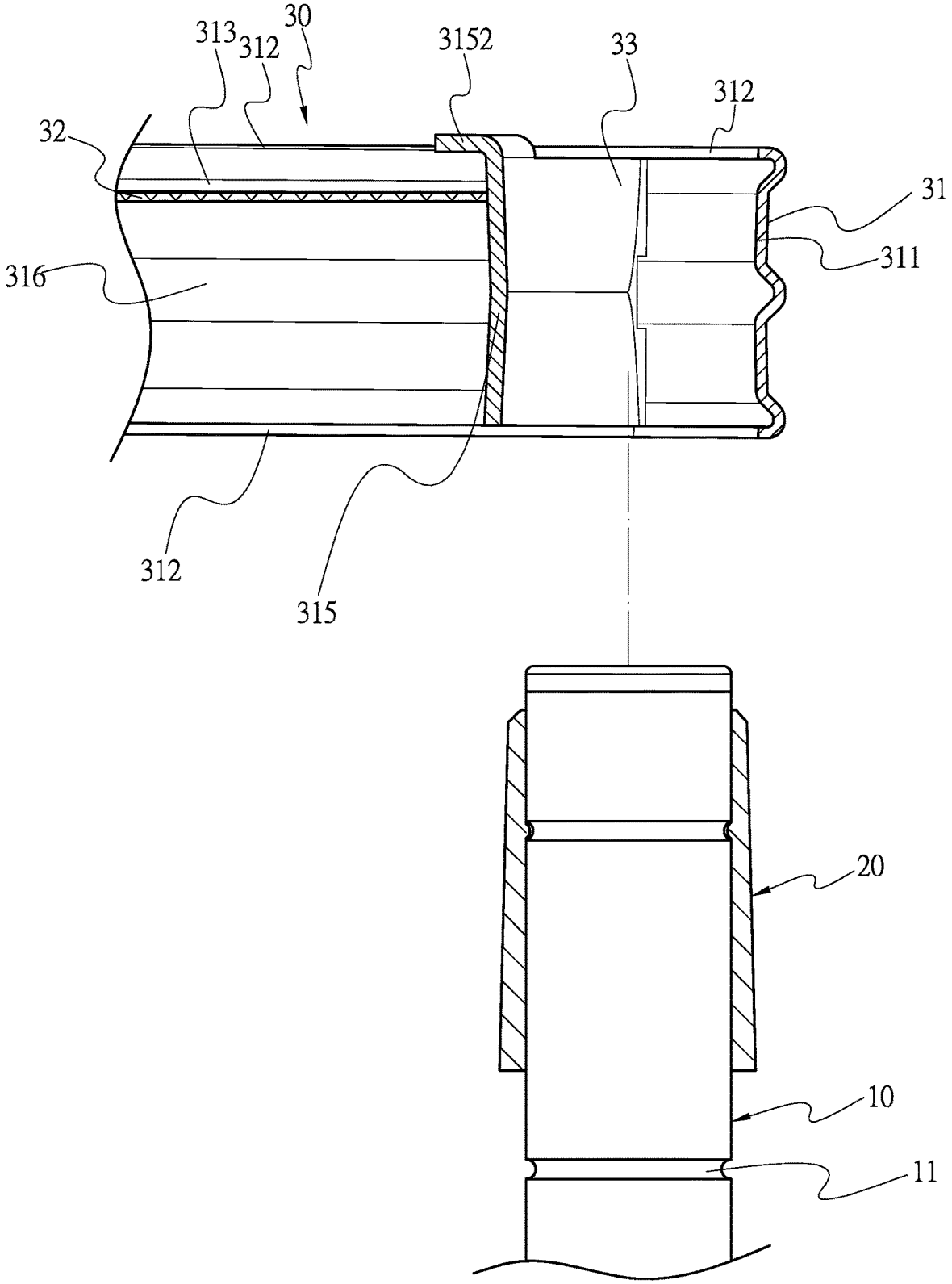
FIG. 5 is an exploded cross-sectional view of the column and the supporting board according to the preferred embodiment of the present invention.
Figure 6:
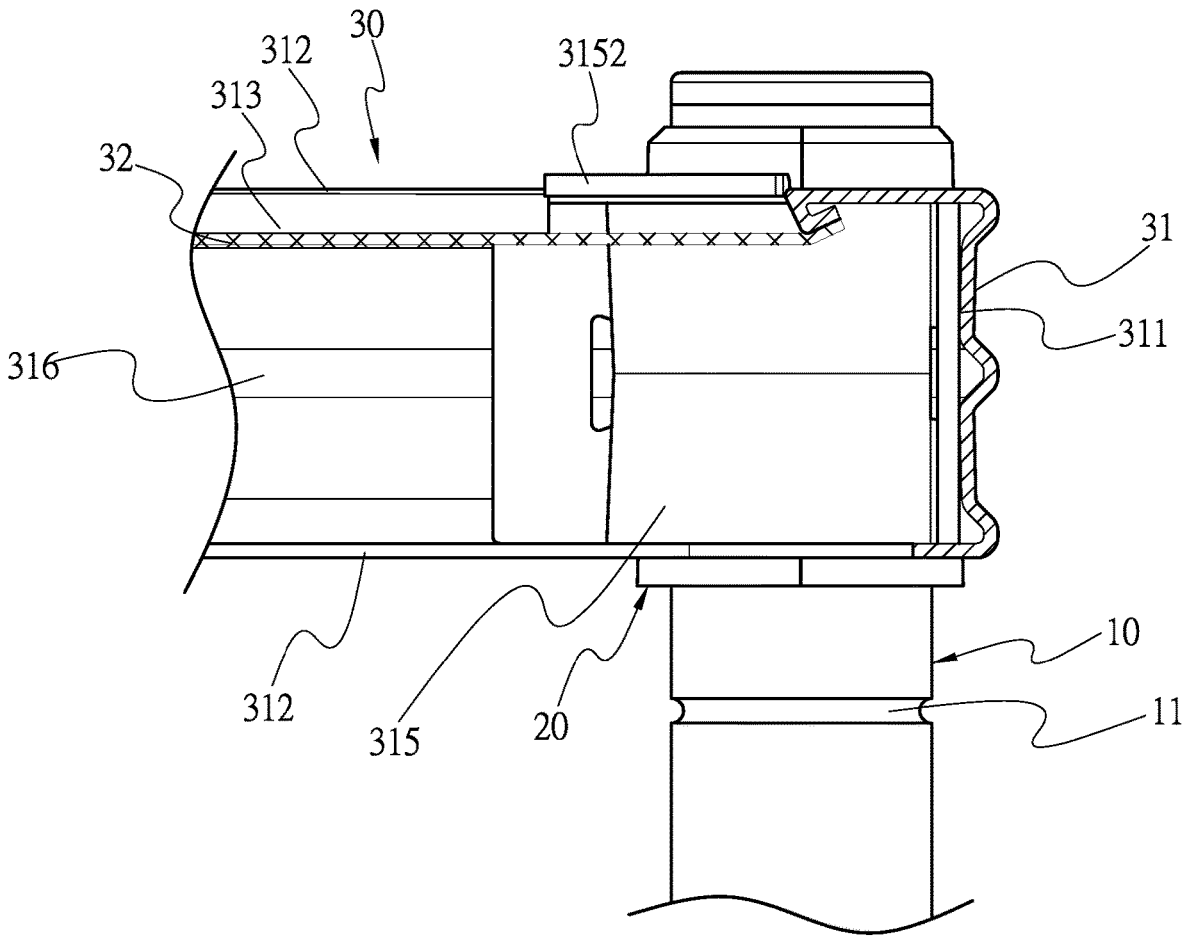
FIG. 6 is an assembly drawing of the combination the column and the supporting board according to the preferred embodiment of the present invention.
Figure 7:
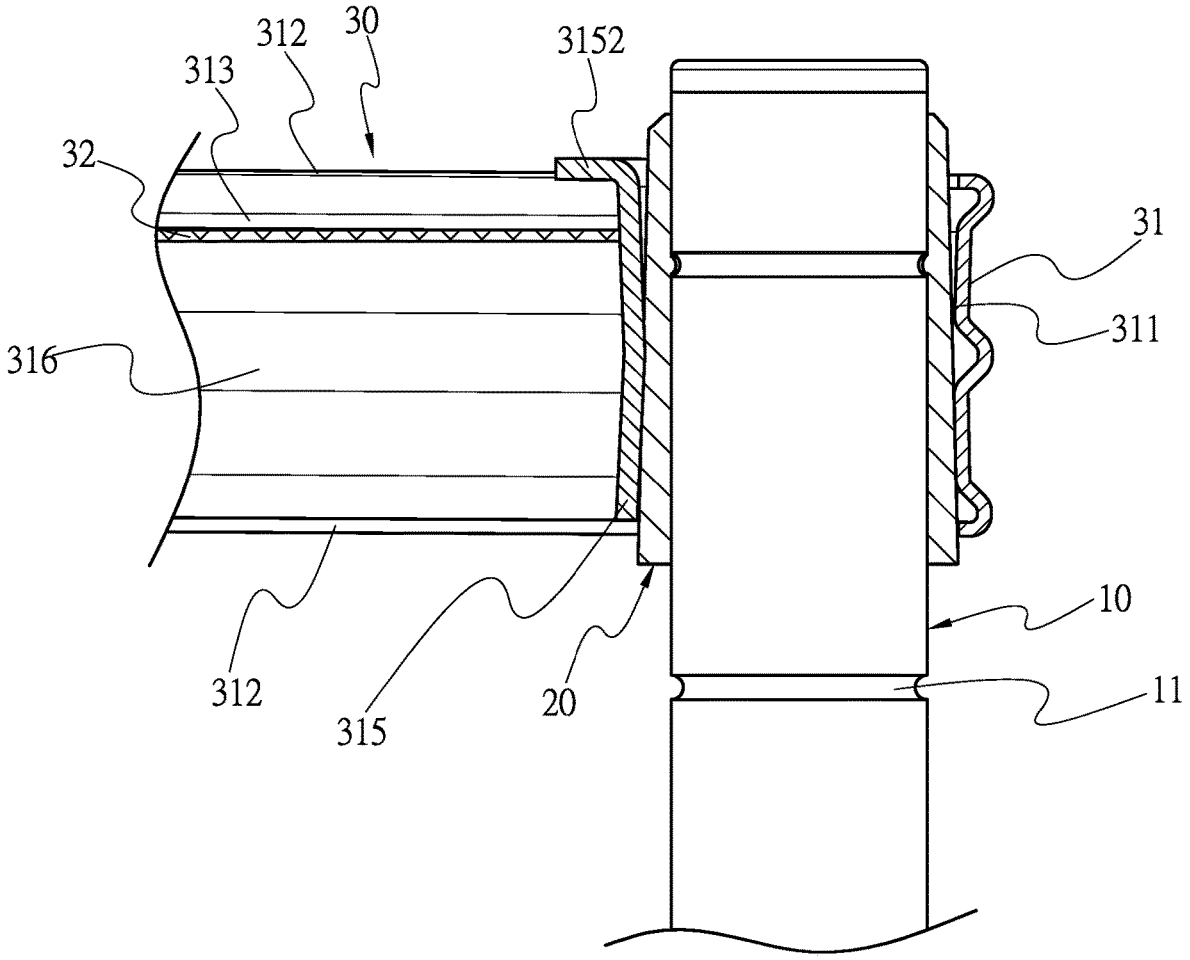
FIG. 7 shows the guardrail being below the supporting board according to the preferred embodiment of the present invention.
Figure 8:
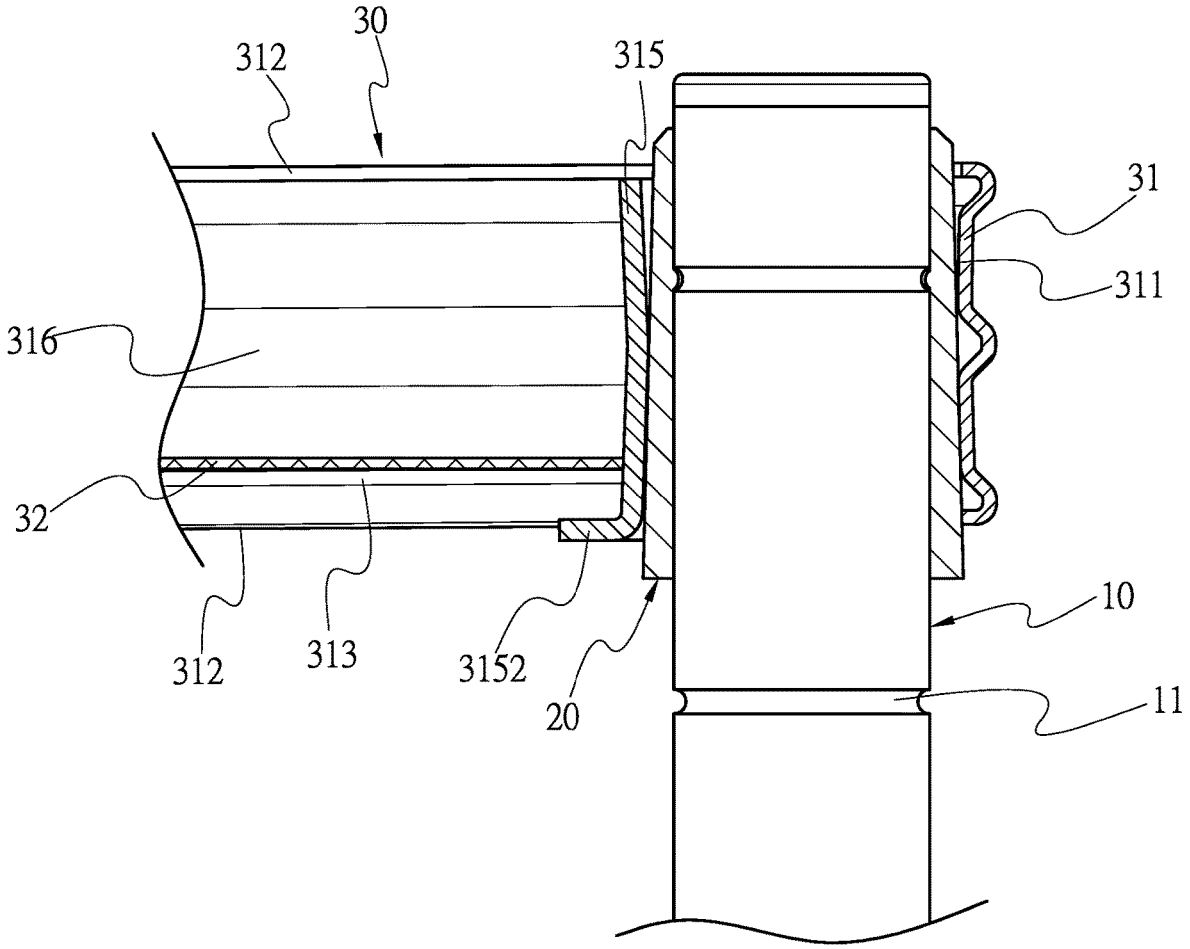
FIG. 8 shows the guardrail being above the supporting board according to the preferred embodiment of the present invention.
Figure 9:
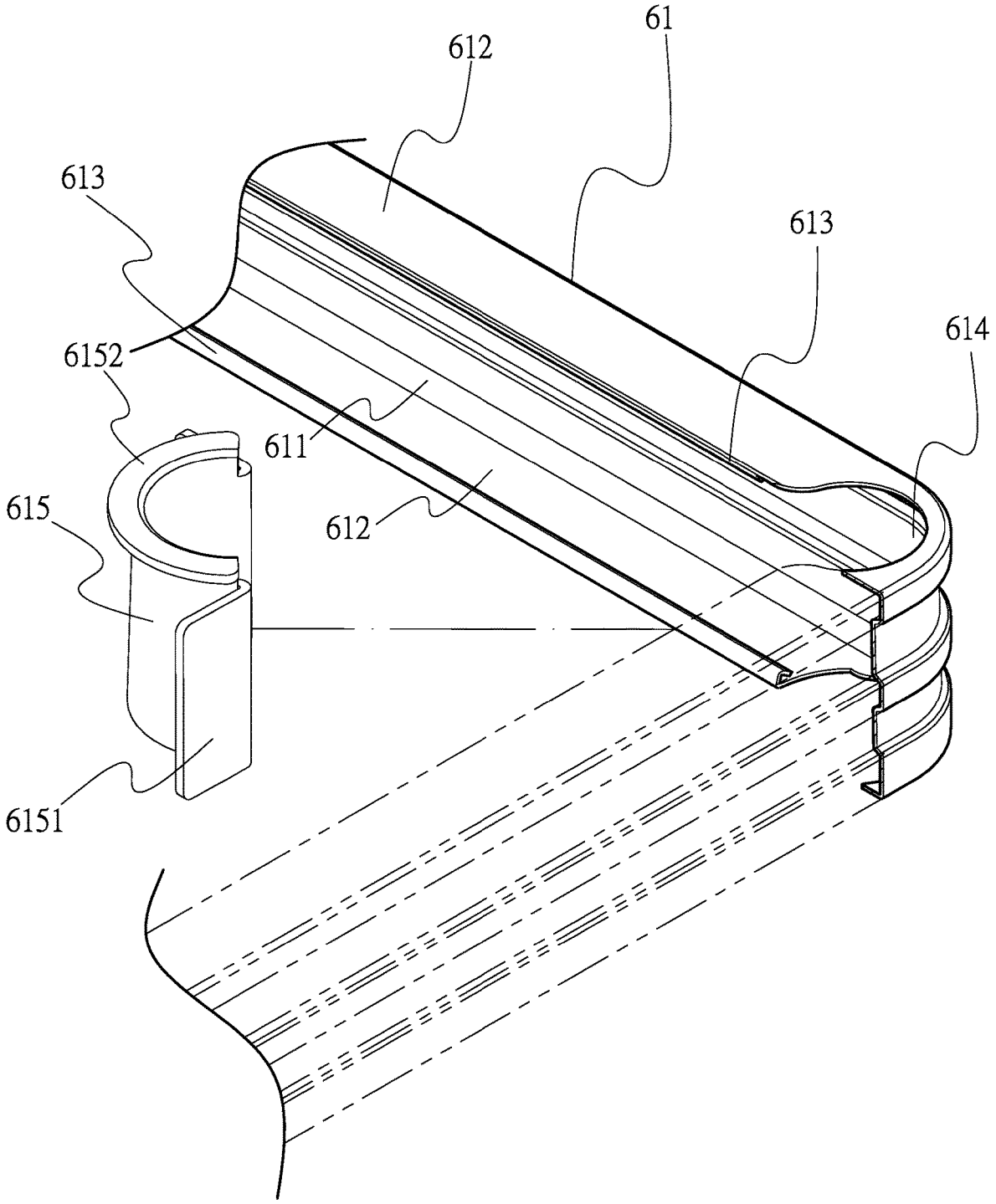
FIG. 9 PRIOR ART
FIG. 9 is a three-dimensional exploded view of prior art.
Figure 10:
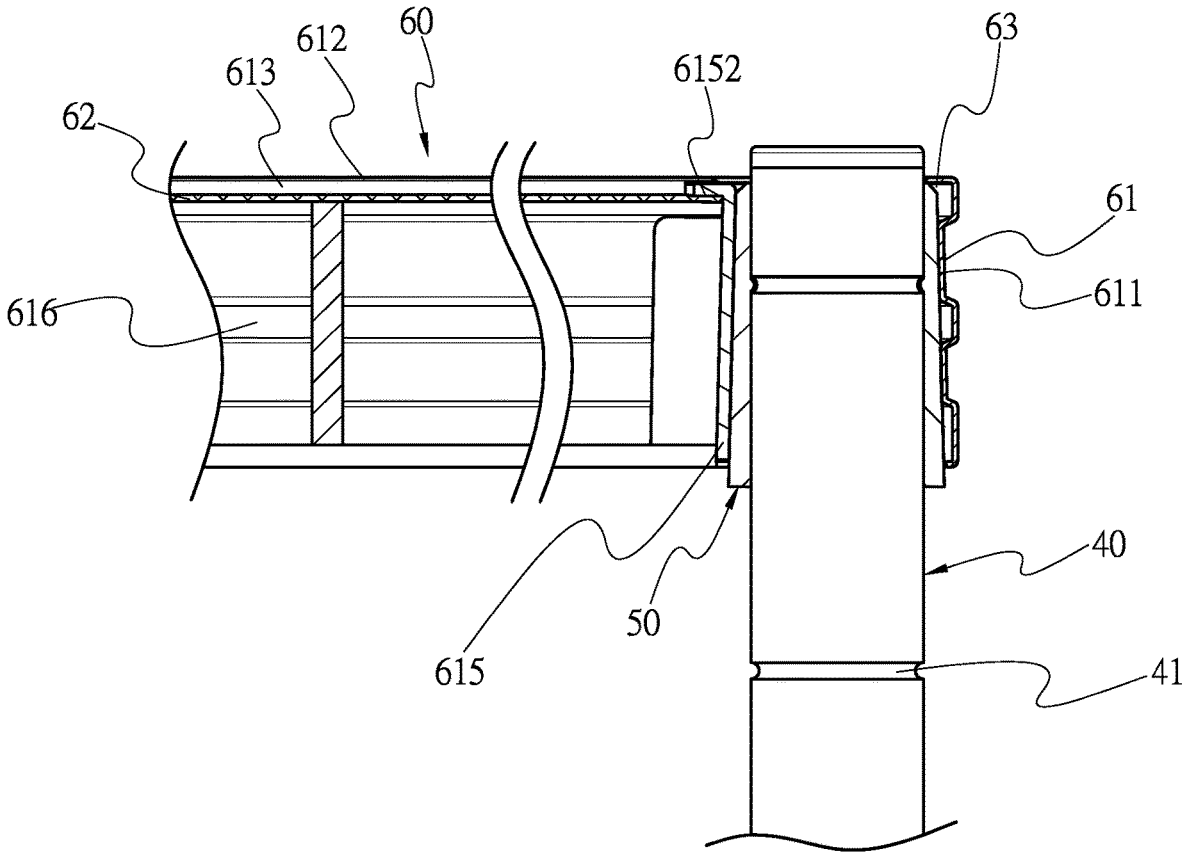
FIG. 10 PRIOR ART
FIG. 10 is a cross-sectional view of the combination of the conventional column and supporting board combination.

The structure is shown in FIGS. 2 and 3. The frame 31 of the supporting board 30 is attached with the assembling arc member 315 at the concave arc groove 314 at the corner end, is fixed, the assembling The wing portions 3151 of the arc member 315 are inserted into the frame 31 from on both sides, and the wing portions 3151 are welded to the raised surface 311 of the frame 31. The abutting rib 3152 of the assembling arc member 315 makes contact with the horizontal ribs 312 on both sides of the concave arc groove 314, so that the assembling arc member 315 is fixed to the corner end of the frame 31. The board member 32 is disposed above the frame 31, and the four peripheral edges of the board member 32 are respectively secured by the horizontal ribs 312 of the frame 31.

For actual assembly, please continue to see from FIG. 1, FIG. 2, FIG. 5 and FIG. 6. The supporting board 30 is installed among the four columns 10, and each column 10 is jacketed by the circular gasket 20 horizontally. With the fastening rib 21 of the circular gasket 20 and the positioning groove 11 of the column 10, the circular gasket 20 is mounted with the column 10, and the casings 33 of the supporting board 30 at the four corners respectively pass through the four columns 10 and engage with the circular gaskets 20, so that the middle section of the assembling arc member 315 pushes against the circular gasket 20 and the circular gasket 20 presses against the raised surface 311 of the frame 31. Therefore, the supporting board 30 is engaged with the circular gasket through the casings 33, and the circular gasket 20 is tightly assembled on the column 10 by the casing 33 of the supporting board 30.

In a preferred embodiment, the wing portions 3151 are welded and fixed to the frame 31.

In a preferred embodiment, the board member 32 is welded and fixed to the horizontal rib 312 on the upper edge of the frame 31.

In a preferred embodiment, the supporting board 30 is provided with at least one reinforcing rod 34 inside, and the reinforcing rod 34 is connected between two parallel longer edges of the frame 31.

With the above structure, since the concave arc groove 314 of the frame 31 and the inner wall of the assembling arc member 315 are inclined from the middle section to the outer side of the upper and lower ends, through the assembling arc member 315 and the concave arc groove 314 together form the hollow hourglass-shaped casing 33, the supporting board 30 can be flipped over and assembled on both sides, so that the user can choose whether to have the guardrail 316, which greatly increases the convenience of use.

Although the present invention has been explained in relation to its preferred embodiment, it is to be understood that many other possible modifications and variations can be made without departing from the spirit and scope of invention as hereinafter claimed.

What is claimed is:

1. A shelf structure comprising:

at least four columns, and at least one supporting board provided with a plurality of circular gaskets respectively jacketing onto the columns;

wherein each column has a plurality of positioning grooves;

each circular gasket has a tapered shape and a fastening rib on an inner surface;

the supporting board comprises a frame and a board member, the frame comprising a raised internal surface, four top edges and four bottom edges of the frame are respectively provided with a horizontal rib, and each horizontal rib on the top edges further has a protecting lip;

each horizontal rib respectively forms a concave arced groove at each corner of the frame, and each concave arced groove comprises an assembling arc member with two wing portions at each side thereof configured to engage with the frame, each assembling arc member and the concave arc groove forming a centrally tapered hollow casing defining an hourglass shape for engaging with a respective circular gasket, the board member accepted in the frame and secured with the horizontal ribs of the frame, a portion of the frame without the board member defining a guardrail.

2. The shelf structure as claimed in claim 1, wherein a top end of each assembling arc member has a horizontal bent abutting rib higher than the two wing portions on the sides.

3. The shelf structure as claimed in claim 1, wherein each wing portion is welded onto the frame.

4. The shelf structure as claimed in claim 1, wherein the board member is welded onto the horizontal ribs of the frame.

5. The shelf structure as claimed in claim 1, wherein the supporting board further has a least one reinforcement bar mounted between two parallel longer edges.

* * * * *